US006925968B1

(12) United States Patent
Hwang et al.

(10) Patent No.: US 6,925,968 B1
(45) Date of Patent: Aug. 9, 2005

(54) PORTABLE HIGH PRESSURE STEAM GENERATOR FOR CAR WASHING WITH GAS HEATER

(76) Inventors: Pil Sun Hwang, 403, 2117-1 Namsan 3-Dong, Jung-Ku, Taegu (KR); Kyung Aie Chae, 18600 E. Colima Rd. #X103, Lowland HTS, CA (US) 91748; Kyung Soo Kim, 403, 2117-1 Namsan 3-Dong, Jung-Ku, Taegu (KR)

( * ) Notice: Subject to any disclaimer, the term of this patent is extended or adjusted under 35 U.S.C. 154(b) by 0 days.

(21) Appl. No.: 10/918,793

(22) Filed: Aug. 16, 2004

(51) Int. Cl.[7] ..... F22B 27/00
(52) U.S. Cl. ..... 122/40; 122/DIG. 10
(58) Field of Search ..... 122/17.1, 40, 404, 122/DIG. 10

(56) References Cited

U.S. PATENT DOCUMENTS 2,699,155 A * 1/1955 Olson et al. ..... 122/274
4,158,248 A * 6/1979 Palmer ..... 15/321
4,414,037 A * 11/1983 Friedheim ..... 134/35
5,419,308 A * 5/1995 Lee ..... 122/14.21
5,673,715 A * 10/1997 Carter ..... 134/104.4
6,675,437 B1 * 1/2004 York ..... 15/321

* cited by examiner

*Primary Examiner*—Gregory Wilson
(74) *Attorney, Agent, or Firm*—Eugene Oak

(57) ABSTRACT

A portable steam generator for automobile washing is provided. The steam generator of the current application is to produce a steam of pressure 6 KG/cm$^2$ at a rate of 30 kg/hr. The steam generator uses natural gas as a heat source. The inner structure of the steam generator is designed to increase the contact of the heat with the steam generating chamber while minimizing heat exchanging tubes inside the chamber. The steam generator weights only 25 Kg and has dimension of 572 mm in height by 400 mm in outer diameter. Whole unit including gas burner is mounted on one structure.

1 Claim, 5 Drawing Sheets

PORTABLE HIGH PRESSURE STEAM GENERATOR FOR CAR WASHING WITH GAS HEATER

FIELD OF THE INVENTION

Current application relates with a steam generator producing steam of pressure 6 $KG/cm^2$ at a rate of 30 kg/hr.

BACKGROUND OF THE INVENTION

Steam generators are designed to produce a large amount of steam to use the moisture of the steam itself. Most of portable steam generator is comprised of water tank wherein electric heaters are installed. Those electric steam generators are easy to make in a compact module and easy to handle. However, due to the inner structure of the steam generating vessel, water tank, there is limit to raise the pressure of the generated steam. The other drawback of those electric heaters is the high electricity cost. The low pressure steam produced by the electric steam generator is not high enough to wash out dirt from a vehicle. Traditional boilers can produce steam of higher pressure and temperature more easily. However, they are designed to utilize the high temperature and pressure of the steam, rather than the moisture of the steam. Those boilers have many tubes in the steam generating vessel to increase the heat transfer capacity. Those boilers are economical for producing steam at a pressure higher than 10 $Kg/cm^{2.}$ The production rate of the steam increases with the number of pipes in the steam generating chamber. Most of all, those boilers are too heavy to manufacture in a compact module.

DESCRIPTION OF THE PRIOR ARTS

U.S. Pat. No. 6,397,788 to Besik illustrates a compact, gas fired steam generator comprised of a steam separation chamber integrated with vertical fin tubes, a down corner tube and a tube header immersed in a thermally insulated firebox chamber provided with horizontally firing gas burners, a condensing heat exchanger for recovery of the waste heat from flue gases to preheat the feed water and the return condensate and a heat exchanger to recover waste heat from the blow down boiling water to the incoming feed water, all enclosed in a thermally insulated casing. The steam generator generates low pressure steam at higher rate. However, the structure is much too complicated.

U.S. Pat. No. 6,135,062 to Palmers illustrates a steam generator of the type incorporating a heating body provided with means for supply of heat to the body and with at least one internal cavity provided with a connection for supply of water, which shall be evaporated and with an outlet for water that has been transferred to steam, whereby the connection of the steam generator for supply of water is provided in the bottom of the cavity, and that the steam generator is equipped with a control system, which permits supply and also discharge of water via the connection, and which is adapted to maintain a constant feeding pressure on the water independent of the direction of water flow. The steam generator of this design has a very thick heating medium to control the pressure of steam.

U.S. Pat. No. 6,094,523 to Zelina, et al. illustrates a flash steam generator to be used as an integral component of a steam sterilizer. The generator is constructed of a metal block having a first bore drilled lengthwise through the metal block. Surrounding the first bore is a plurality of additional heater bores in which heating elements are inserted. The generator is integral to the sterilizer piping and control systems. Water is supplied to the first bore by the sterilizer piping system, and electricity is supplied to the heating elements by the sterilizer power supply. The heating elements convert the electricity to heat, which transfers via the metal block to the first bore where the heat rapidly boils the water contained therein in what is essentially a flash vaporization process.

U.S. Pat. No. 5,542,021 to Hopper, et al. illustrates a steam generator for a wall paper steamer having a two section boiler. The boiler is mounted in a framework of lightweight aluminum tube, having two trapezium ends and interconnecting members. The boiler is secured to bottom members. Top members support a stepping board. That kind of steam generators can produce 'hot moisture stream'. The pressure of the steam generated from that type generator is atmospheric or too low to remove any dirt from the surface of a car.

U.S. Pat. No. 4,974,411 to Bruckner, et al. illustrates a super-charged, coal-fired steam generator that has an exhaust gas vent line connected to the gas turbine. The steam generator includes at least one sub-stoichiometrically operated fluidized bed furnace system. That steam generator is too big to be installed in a car washing place. U.S. Pat. Nos. 2,044,270 and 2,271,880 to Wood illustrate steam generators that have many inner pipes carrying waters. Steam generators of that kind have too many pipes and too heavy to install on a module.

None of the prior arts illustrates a simple and light steam generator of the current application for producing medium pressure steam at high rate.

SUMMARY OF THE INVENTION

Conventional boilers, which are very heavy, can produce high pressure steam but they take a long time to generate steam from the start up of the gas burner. Meanwhile, conventional simple structured electric steam generators produce low pressure steam relatively fast. The steam generator of the current application produces 6 $kg/cm^2$ steam at a rate of 30 kg/hr. The steam generator uses gas as a heat source. The inner structure of the steam generator does not have heat exchanging inner tubes to make it easy to clean the inside. Main body of the steam generator is made of 3 mm thickness steel plate roll pressed. The steam generator of the current application has smaller volume and lighter weight than the conventional steam boiler. The whole unit, including a gas container, is mounted on one structure. For the safety reason, special valve control system is adapted to cut the gas if the ignition is failed.

DETAILED DESCRIPTION OF THE PREFERRED EMBODIMENT

Figure 1:
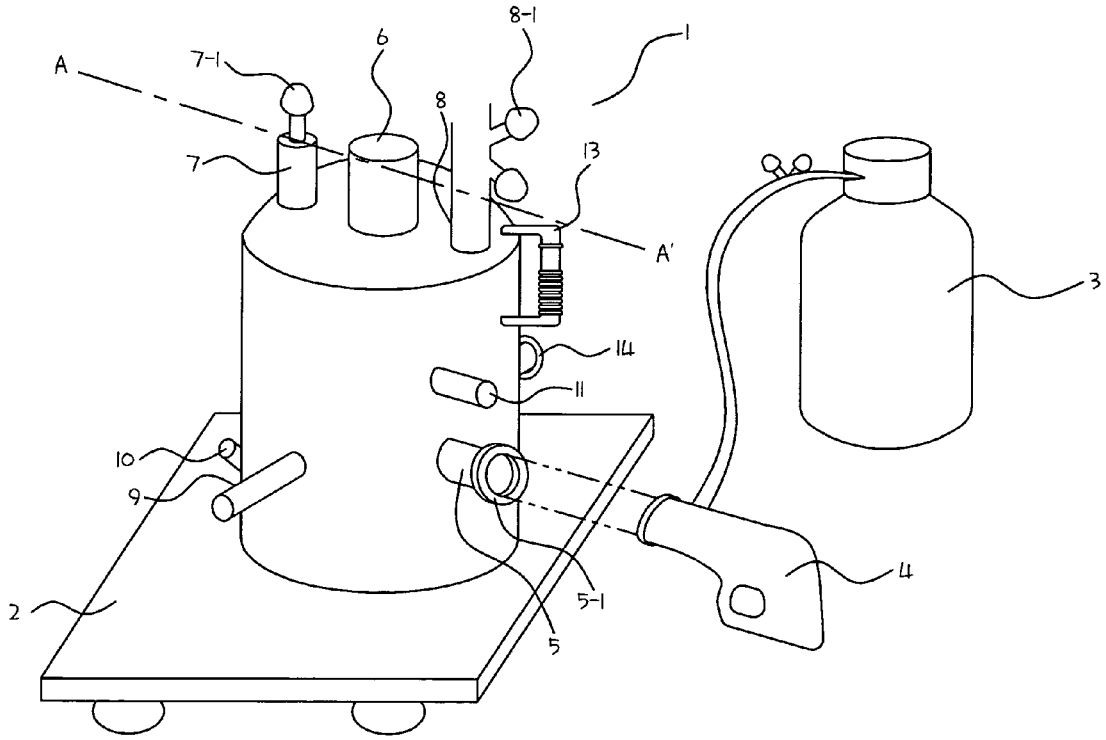
FIG. 1 is a perspective view of a steam generator of the current application mounted on a mobile unit.

FIG. 1 is a perspective view of a steam generator (1) of the current application mounted on a mobile unit (2). The generator (1) uses gas in a gas container (3) as a heat source. A gas burner (4) is connected to the steam generator (1) via a flange (5-1). The residual heat, carbon dioxide and un-burn gas is exhausted through the exhausting gas vent line (6), which is developed from the upper burning zone (A) penetrating a steam generating chamber (16) and extruded from the top of the steam generator (1). The maximum pressure of the steam is controlled by setting the collapsing pressure of the rupture disc valve (7-1) at the desired pressure, which is connected to rupture disc line (7), which is developed on one corner of the upper surface of the steam generating chamber. The pressure of the steam supplied to a car washier is controlled by the line regulators (8-1) attached to the steam out line (8), which is developed on the other corner of the upper surface of the steam generating chamber. Purified tap water is introduced to the generator (1) through water supplying pipe (9), which is developed on an outer side of the steam generating chamber. A drain pipe (10) is developed on out side of the bottom of the steam generating chamber (16) forming a right angle with the water supplying pipe. A water level gauge (13) is installed at the upper corner of the steam generator (1). A cleaning hole (14) is developed on an outer side of the steam generating chamber (16) in the opposite direction of the water supplying pipe (9) to clean the inside of the steam generating chamber (16).

Figure 2:
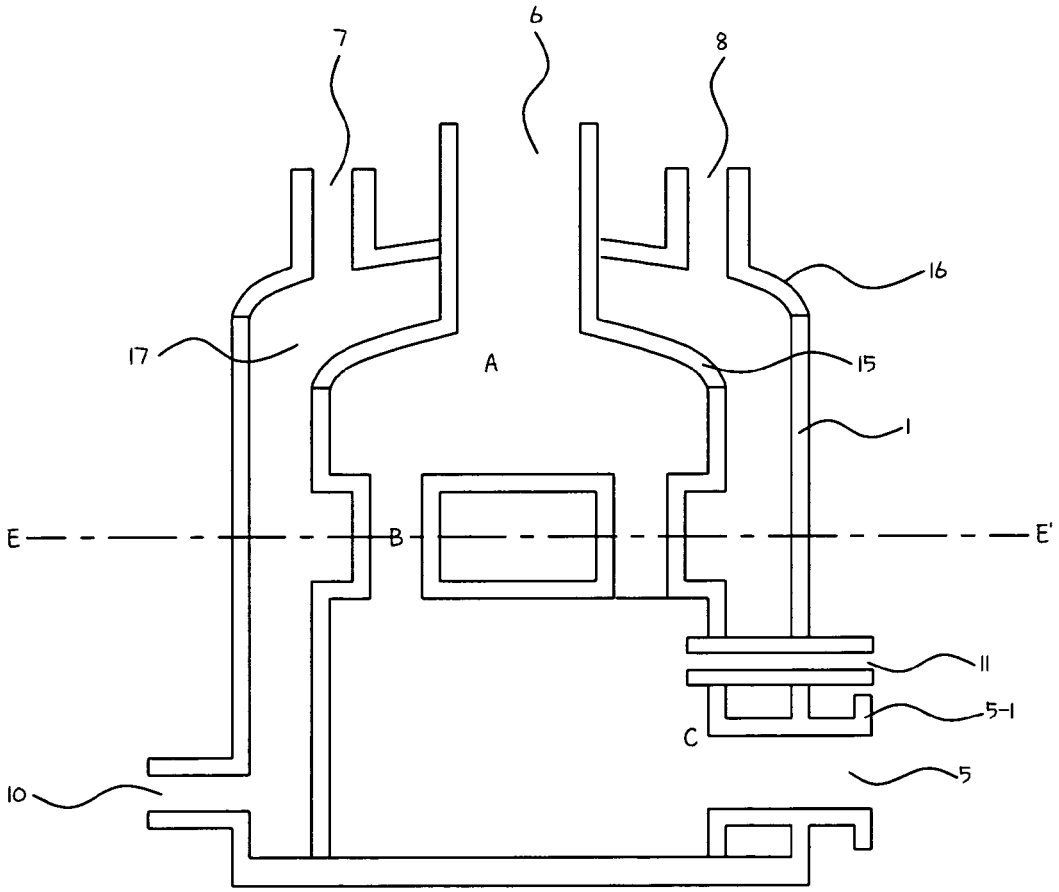
FIG. 2 is a vertical cross-sectional view of the steam generator of the current application along the line "A–A'".
Figure 3:
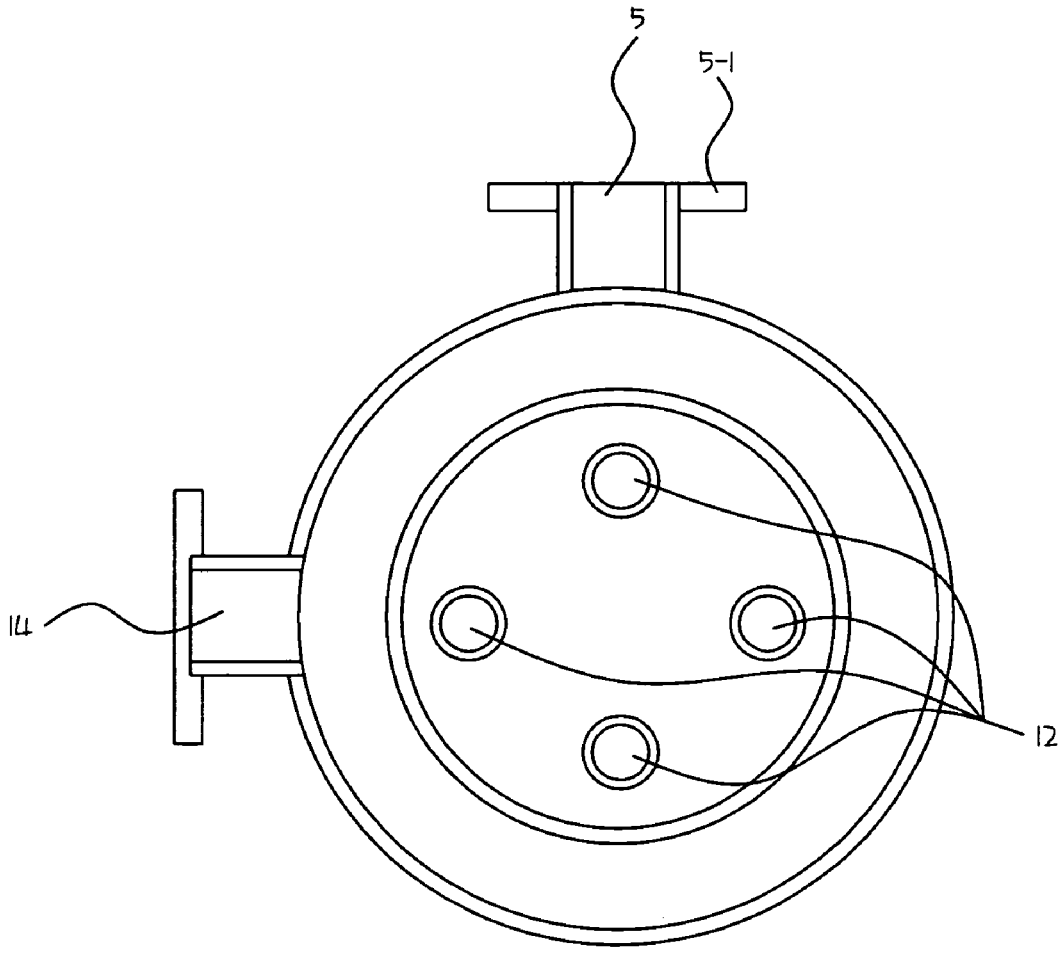
FIG. 3 is a planar cross-sectional view of the steam generator of the current application along the line "E–E'" in FIG. 2.
Figure 4:
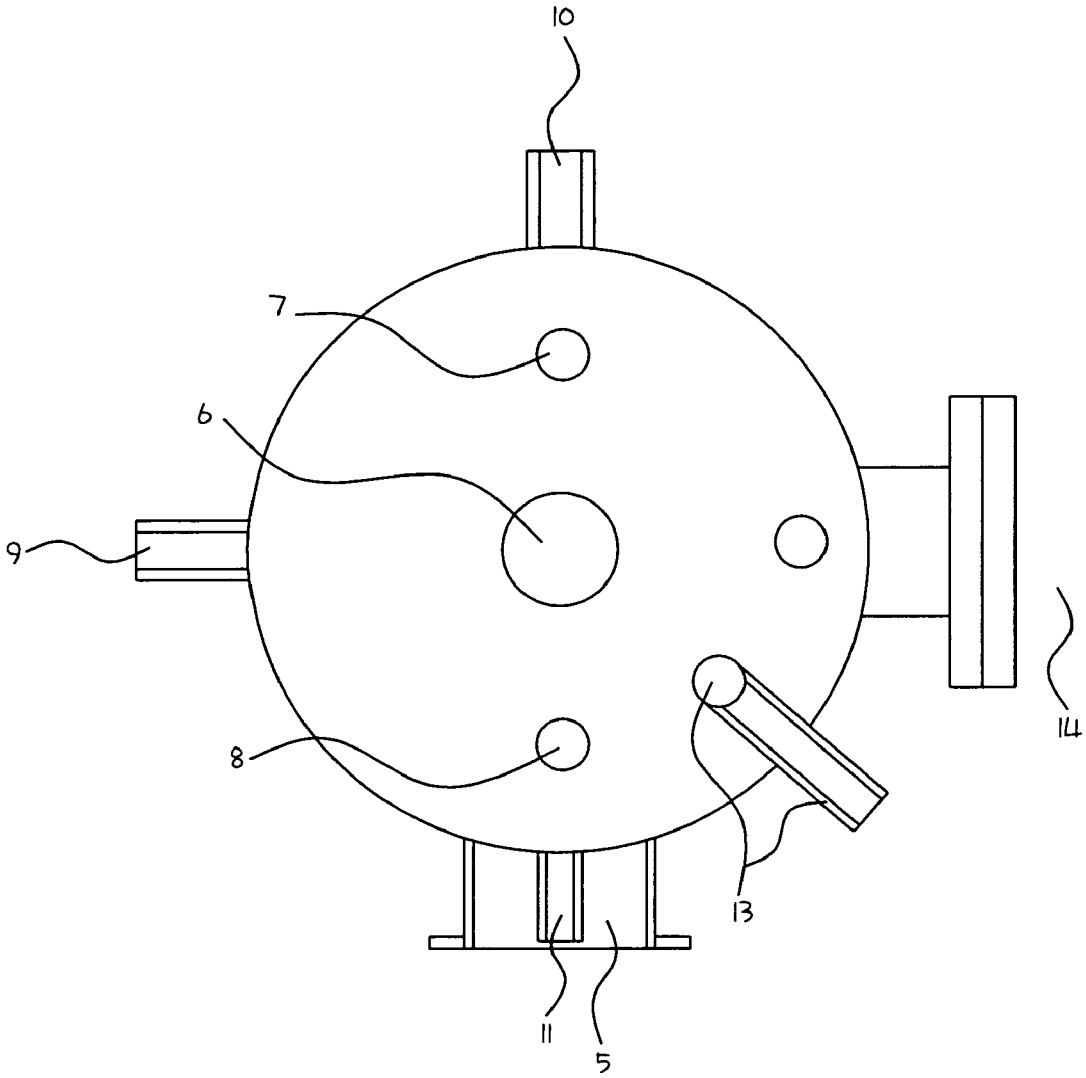
FIG. 4 is a top plan view of the steam generator of the current application.

FIG. 2 is a vertical cross-sectional view of the steam generator (1) of the current application along the line "A–A'". The combustion chamber (15) and the steam generating chamber (16) of the generator (1) are made of 3 mm thickness rolled steel plates. The combustion chamber (15) is divided into three zone of (A), (B), and (C) to increase the contacting area of the heat and the water (17) inside of the steam generating chamber (16), which surrounds the combustion chamber (15) except the bottom. When the flame of the gas enters into the lower burning zone (C) through the burner inlet line (5), which is developed on an outer side of the generator in the opposite direction of the drain pipe and extended to the lower burning zone (C) of the combustion chamber penetrating the steam generating chamber, the flame heats the water first that is introduced through the water inlet (9). After that the flame of the burning gas pass through the four pipes (12) of 6 cm diameter as shown in FIG. 3, which is planar cross-sectional view of the steam generator of the current application along the line "E–E'" in FIG. 2. The flame of the burning gas through these pipes (12) heats the water in the middle section of the steam generating chamber (16), which is already warmed by the flame of the burning gas in the lower burning zone (C). After pass through the four pipes (B), the flame reaches to the upper burning zone (A) of the combustion chamber (15) and heats the already hot water and then exhausted through the vent line (6). The status of the combustion chamber (15) is observed through the insight glass (11) developed above the burner inlet line (5) and penetrating the steam generating chamber (16) to reach the inside of the combustion chamber (15). Two out lets, rupture disc line (7) and steam out line (8), from the top of the steam generating chamber (16) are connected to a rupture disc (7-1) and line regulator (8-1). The steam out let line (8) is connected to a car washing machine, which is not illustrated in this application. FIG. 4 is a top plan view of the steam generator (1) of the current application that shows the relative position of the level gauge (13) around the external horizontal perimeter of the generator (1).

Figure 5:
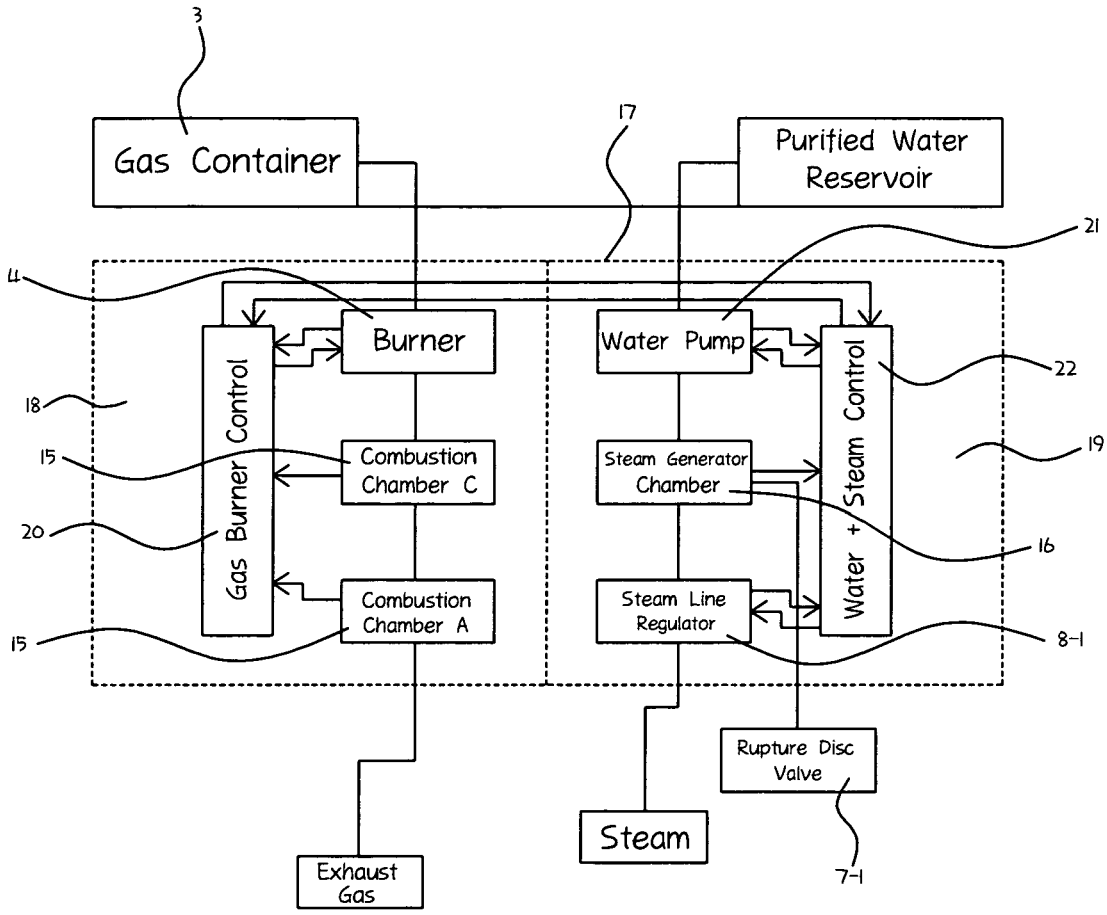
FIG. 5 is a schematic diagram of electronic control loop for the steam generator of the current application.

FIG. 5 is a schematic diagram of electronic control loop for the steam generator (1) of the current application. The control loop (17) is divided into two sections of gas burner control loop (18) and water plus steam control loop (19).

Sensors, which is not shown in the figures, from the gas container (3), burner (4), combustion chamber (15)'s lower section 'C', combustion chamber (15)'s upper section 'A' are connected to the gas burner controller (20). If the ignition of the burner is failed, i.e., the temperature of the combustion chamber is not high enough, the burner controller (20) send out a signal to the gas valve, which is not shown in the figures, to open more and provide more gas.

Sensors, which are not illustrated in the current application, from the water pump (21), the steam generating chamber (16), the level gauge (13) and the steam line regulator (8-1) are connected to the water and steam controller (22). The water and steam controller (22) controls the water pump (21) by the water level reading from the level gauge (13).

The gas burner controller (18) and the water and steam controller (22) exchange the temperature readings from the combustion chamber (15), steam generating chamber (16), and water level and steam pressure in the steam generating chamber (16) and controls the gas burner (4), water pump (21) and the line regulator (8-1) to control the pressure and amount of steam produced.

The dimension of the generator (1) body is 572 mm in height by 400 mm in outer diameter. And net weight of the generator (1) is only 25 Kg. It is easily installed on a small mobile module.

What is claimed is:

1. A portable, 25 Kg weight, gas fired steam generator with a dimension of 572 mm in height by 400 mm in outer diameter for producing steam of 6 $KG/cm^2$ pressure at a rate of 30 Kg/hr, which is comprised of;

a combustion chamber made of 3 mm thick roll pressed steel plate, which is divided into three zones of a lower burning zone, an upper burning zone, and a middle zone consists of four pipes of 6 cm diameter that connects the lower and upper burning zone and;

a steam generating chamber made of 3 mm thick roll pressed steel plate that surrounds the combustion chamber except the bottom and;

a water supplying pipe developed on an outer side of the steam generating chamber and;

a drain pipe developed on a bottom of an outer side of the steam generating chamber forming a right angle with the water supplying pipe and;

a burner inlet line developed on an outer side of the generator in the opposite direction of the drain pipe and extended to the lower burning zone of the combustion chamber penetrating the steam generating chamber and;

an insight glass developed above the burner inlet line and penetrating the steam generating chamber to reach the inside of the lower burning zone of the combustion chamber and;

a cleaning hole developed on an outer side of the steam generating chamber in the opposite direction of the water supplying pipe and;

a water level gauge installed at the upper corner of the steam generator and;

an exhausting gas vent line, which is developed from the upper burning zone, penetrating a steam generating chamber and extruded out from the top of the steam generator and;

a steam out line developed on one corner of the upper surface of the steam generating chamber and;

a rupture disc line developed on the other corner of the upper surface of the steam generating chamber.

* * * * *